United States Patent [19]

West

[11] 4,373,613

[45] Feb. 15, 1983

[54] VEHICLE BRAKE EQUIPMENT

[75] Inventor: Cecil W. West, Caerphilly, Wales

[73] Assignee: Coal Industry (Patents) Limited, London, England

[21] Appl. No.: 237,570

[22] Filed: Feb. 24, 1981

[30] Foreign Application Priority Data

May 9, 1980 [GB] United Kingdom ..... 8015448

[51] Int. Cl.[3] ..... B61H 7/12

[52] U.S. Cl. ..... 188/43; 188/170

[58] Field of Search ..... 188/43, 44, 41, 42, 188/45, 170, 73.43, 166, 167, 169, 181 R, 181 A, 72.3, 216; 303/71, 2, 3; 180/271, 275

[56] References Cited

U.S. PATENT DOCUMENTS 4,014,413 3/1977 Monks ..... 188/44 X 4,196,798 4/1980 Barsted ..... 188/44 X 4,236,608 12/1980 Kobelt ..... 188/43

4,308,937 1/1982 Johnson ..... 188/43

*Primary Examiner*—Douglas C. Butler

*Attorney, Agent, or Firm*—James C. Wray

[57] ABSTRACT

Brake equipment is provided for a vehicle adapted to travel along a path adjacent to an elongated stationary rail the brake equipment comprising a resiliently applied brake member arranged to abut one side of the stationary rail and a pivotally mounted reaction brake member on the opposite side of the stationary rail to the brake member. The reaction brake member is pivotably clear of the stationary rail along sections of the track, for example, point or crossover arrangements, pivotal movement of the reaction brake member being under the action of an abutment member arranged to abut stationary formations associated with the sections of the track.

13 Claims, 9 Drawing Figures

VEHICLE BRAKE EQUIPMENT

This invention relates to vehicle brake equipment.

In particular, the present invention relates to vehicle brake equipment provided on vehicles which travel along a stationary rail with the brake equipment running adjacent to the stationary rail. With such a vehicle when the vehicle brake is applied a brake pad is urged to contact the stationary rail tending to bring the vehicle to rest.

In a typical installation in which the vehicle is mounted on the stationary rail the brake pad is urged to abut the top of the rail tending to lift the vehicle wheels from the stationary rail. With such an installation the maximum brake effort exerted is dependent upon the weight of vehicle. In order to obtain increased maximum braking effort it is known to provide reaction members arranged to run along the stationary rail on the side opposite to the brake pad. Thus, when the vehicle brake is applied the stationary rail tends to be clamped between the brake pad and the reaction member and the maximum braking effort tends to be dependent upon the force urging the brake pad towards the rail rather than upon the vehicle weight. Unfortunately, in many installations it is not possible to provide such a reaction member because of obstructions intermittently located in the desired path of the reaction member. Such obstructions would be encounted at for example, point or crossover arrangements.

An object of the present invention is to provide vehicle brake equipment which tends to overcome or reduce the above mentioned problem and which tends to permit reaction members to be used on vehicles associated with rail tracks having point and/or crossover arrangements.

According to the present invention vehicle brake equipment for a vehicle adapted to travel along a stationary rail, comprises a body component adapted to be mounted on the vehicle, brake means having a brake applied mode in which a brake member is urged towards the stationary rail with braking effort, and a brake release mode in which the brake member is not urged towards the stationary rail with braking effort, means for applying the braking effort to the brake member when, in use, the brake is applied, movable reaction means having one operational mode in which a reaction brake member is located on the opposite side of the stationary rail to said brake member and having a second operational mode in which the reaction brake member is clear of the stationary rail, drive means for urging the reaction brake member towards said one operational mode, and abutment means which are arrangeable to abut a stationary formation located along a section of the vehicle path and which when abutting the formation are arranged to override the action of the drive means to urge the reaction brake member towards said second operational mode in which the reaction brake member is clear of the stationary rail.

Preferably, the movable reaction means comprises a pivotal mounting for the reaction brake member.

Conveniently, the reaction brake member comprises a generally hook shaped brake shoe.

Preferably, the brake shoe is provided with a brake pad.

Advantageously, the brake shoe comprises a gear tooth formation.

Conveniently, the gear tooth formation is arranged on an arcuate path around the pivotal axis of the pivotal mounting.

Preferably, the abutment means comprises a striker plate for abutment with the stationary formation and a gear tooth formation drivably engaging the gear tooth formation on the brake shoe.

Preferably, the gear tooth formation on the abutment means is arranged on an arcuate path around a second pivotal axis which is substantially parallel to the first mentioned pivotal axis, the abutment means comprising a pivotal mounting means.

Preferably, the brake equipment comprises a slide mechanism arranged adapted to retain the brake shoe in said one operation mode in which the reaction brake member is located on the opposite side of the stationary rail to said brake member.

Conveniently, the brake shoe is recessed to allow movement of the slide mechanism when the brake shoe is in said second operational mode clear of the stationary rail when the brake is applied.

Preferably, the means for applying the braking effort comprises resiliently biassed means.

Preferably, the brake equipment comprises hydraulic means for overriding the action of resiliently biassed means in the brake released mode.

Preferably, the brake equipment comprises vehicle speed sensitive means arranged to actuate the brake means to apply the vehicle brake.

By way of example only, one embodiment of the present invention will be described with reference to the accompanying drawings, in which.

Figure 1:
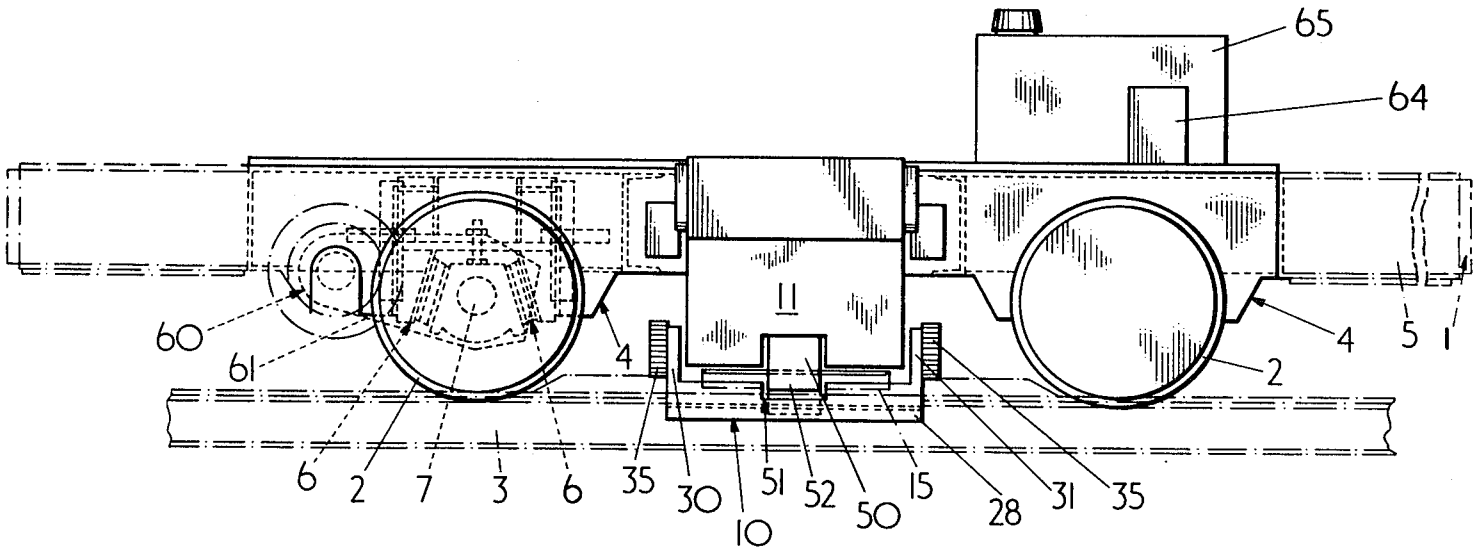
FIG. 1 is an incomplete side view of a rail mounted vehicle provided with brake equipment constructed in accordance with the present invention.
Figure 2:
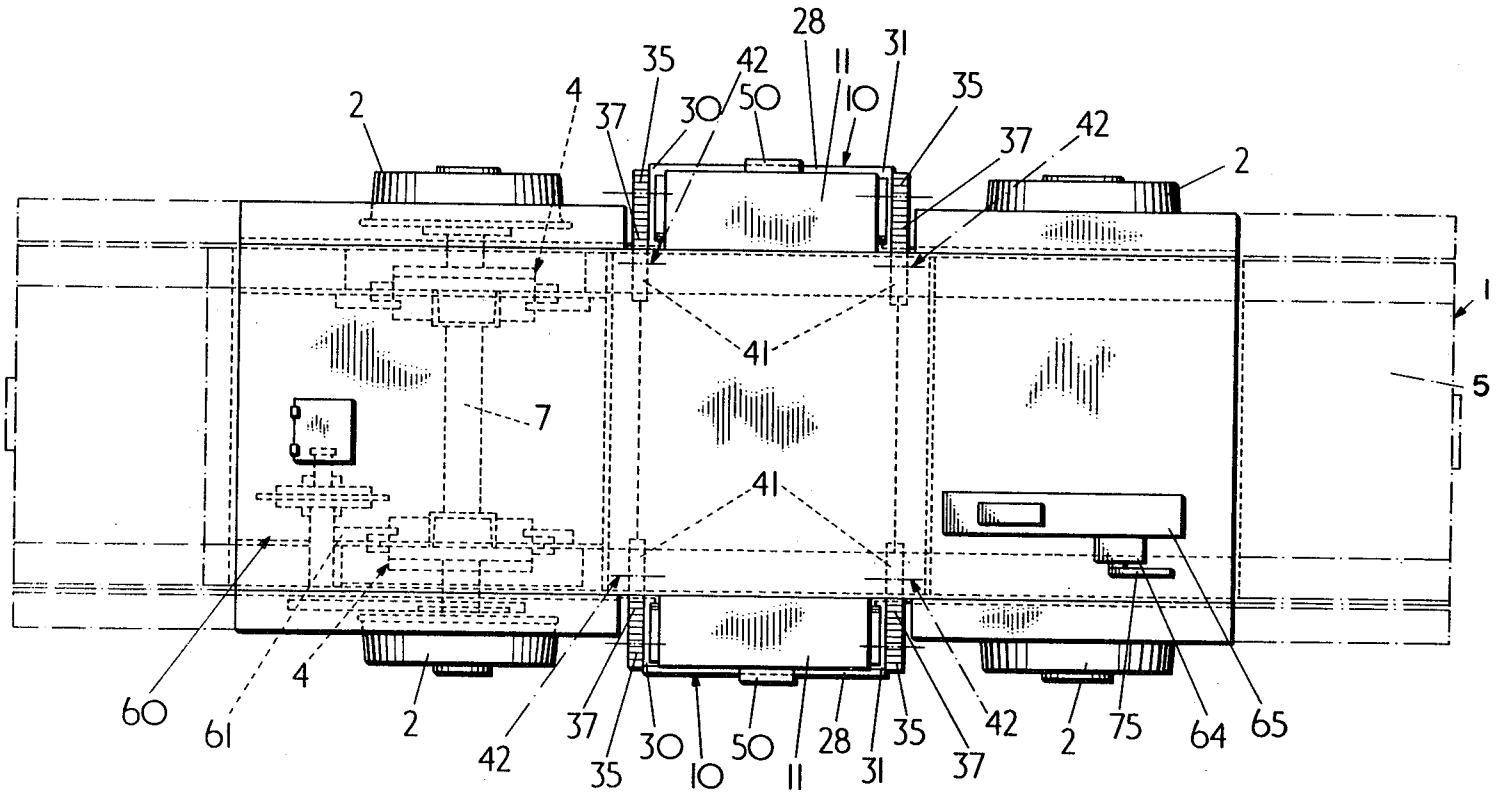
FIG. 2 is an incomplete plan of FIG. 1.

FIGS. 1 and 2 of the drawings show incomplete views of a rail mounted vehicle 1 having two pairs of wheels 2 guidably engaging stationary rails 3 (omitted in FIG. 2) and supported in wheel mountings 4 provided on a chassis 5 which supports a working vehicle deck (not shown). The wheel mountings 4 comprise elastomeric suspension units 6 supportably engaging common axles 7 for each pair of wheels 2. FIGS. 1 and 2 show details associated with one pair of wheels only. However, the other pair of wheel mountings shown only in outline are of similar construction.

The vehicle is hauled along with a train of vehicles connected together by coupling means (not shown) provided on both ends of the chassis 5.

Figure 6:
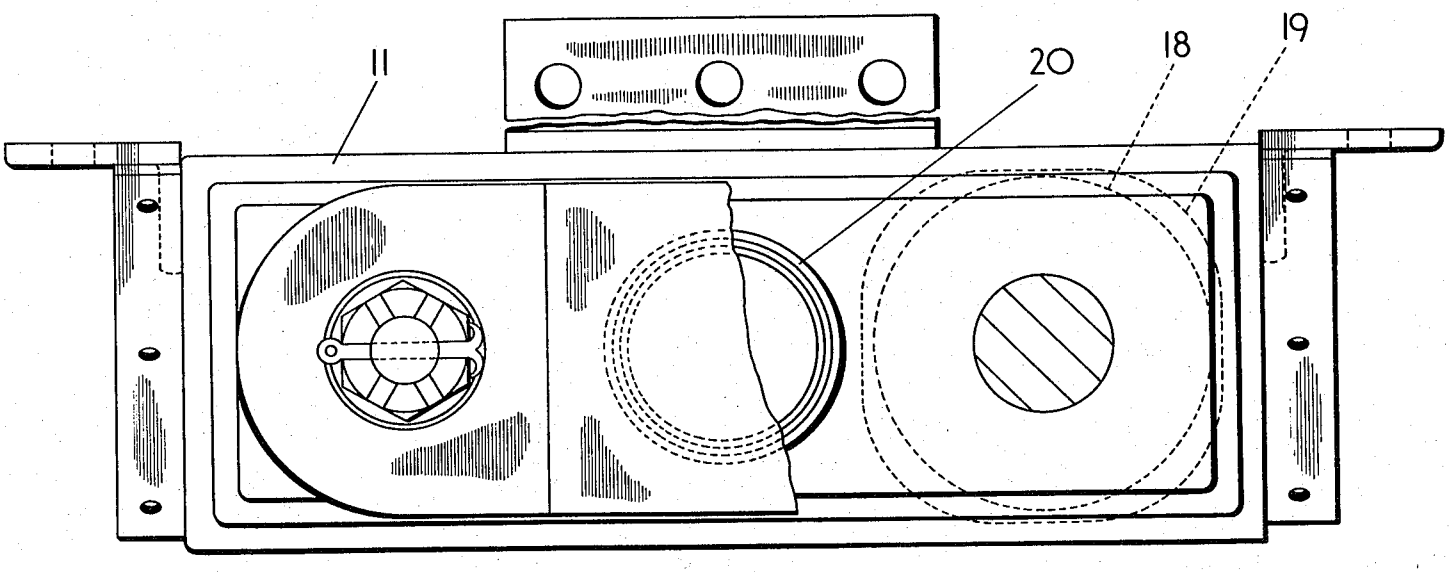
FIG. 6 is a partly sectioned plan of the further detail of FIG. 5.
Figure 7:
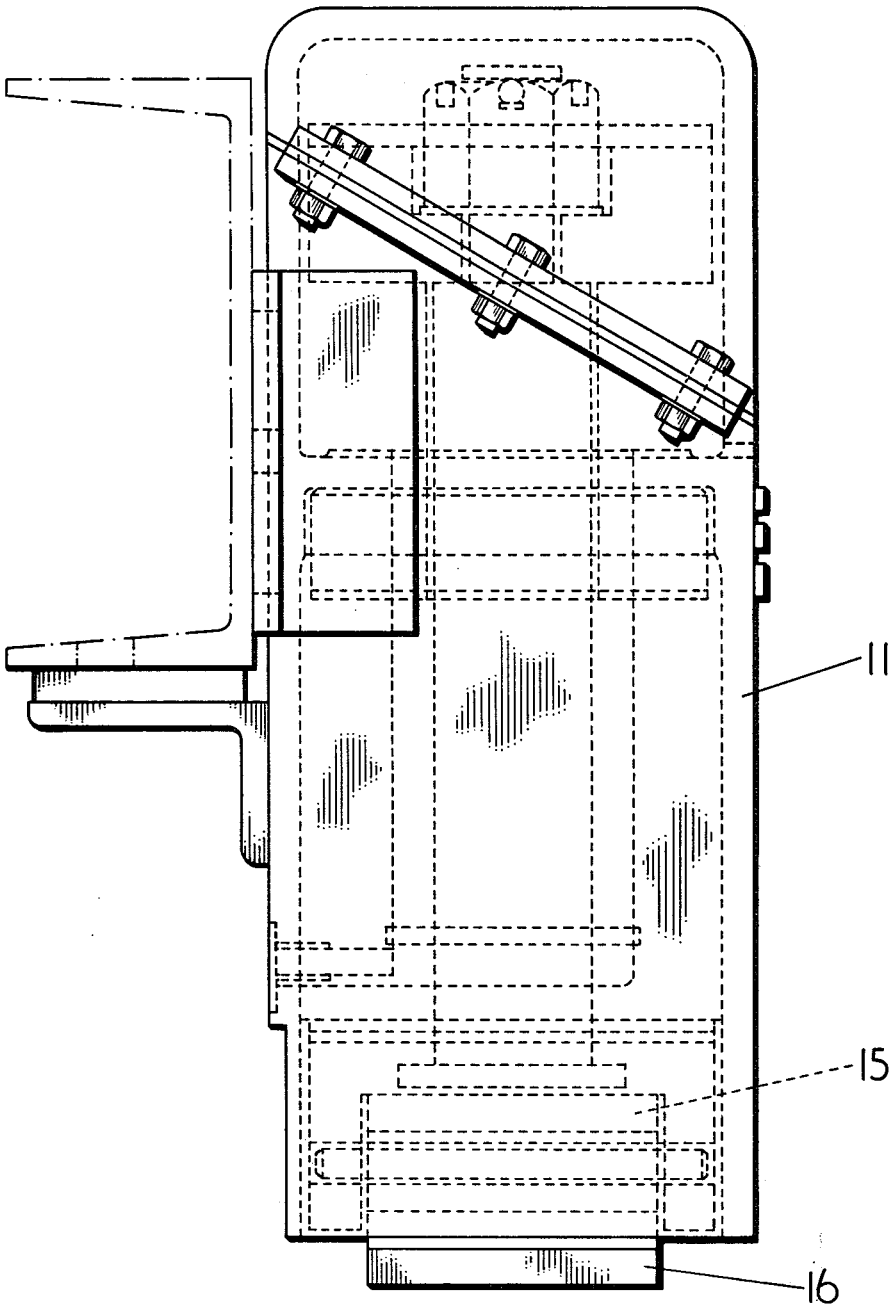
FIG. 7 is an end view of the further detail of FIG. 5.

The vehicle 1 is provided with two sets of brake equipment 10 mounted on opposite sides of the vehicle respectively, and comprising a body component 11 fixedly secured by bolts to the chassis 5. Details of the brake equipment including the body component 11 are disclosed in FIGS. 5, 6 and 7 in which the brake equipment is shown to include brake means comprising a movable brake member or shoe 15 provided with a brake pad 16 and having a brake applied mode in which the brake pad is urged towards the stationary rail 3 to contact the rail under the action of two stacks of resilient disc springs 18 which are housed in cylindrical bores 19 provided in the body component 11 and a brake release mode in which the brake pad 16 is urged clear of the stationary rail 3 by a hydraulically actuated jack 20 housed in a cylindrical bore 21 provided in the body component 11 and the action of which when actuated overrides the action of the resiliently biassed springs 18. The operation of the jack 20 will be described in more detail later in this specification with reference to FIG. 8.

Figure 5:
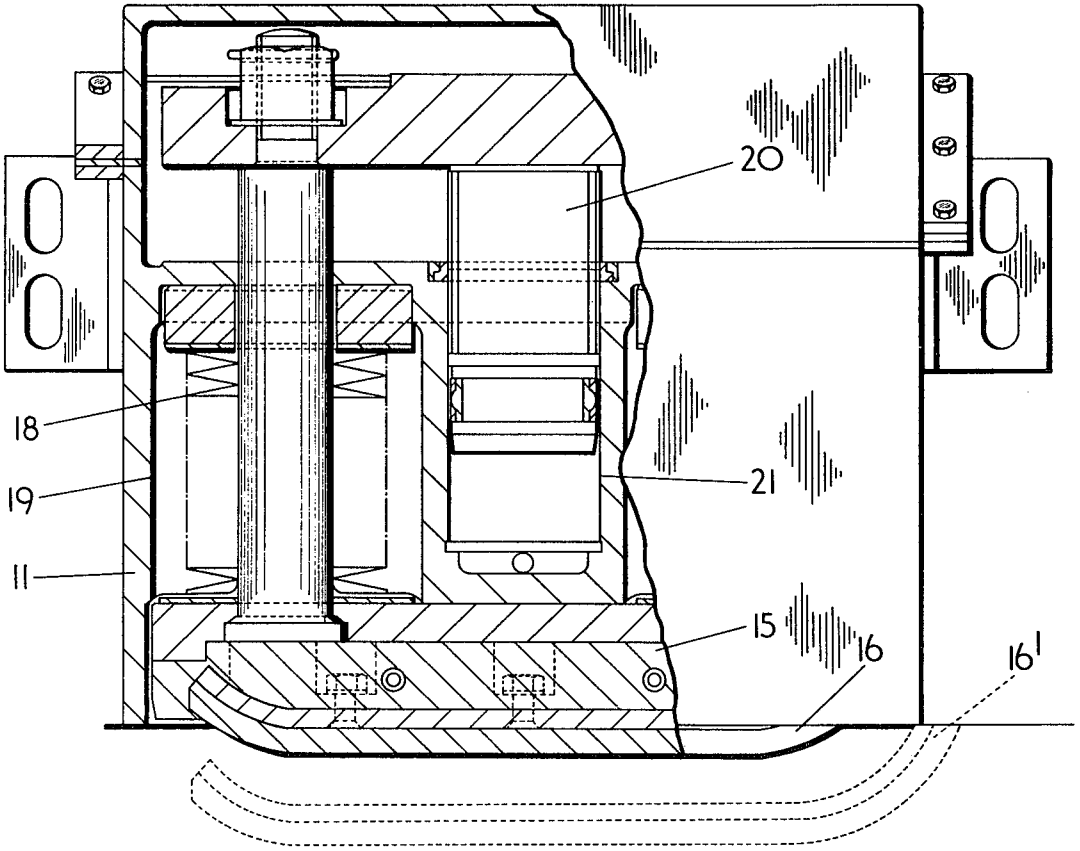
FIG. 5 is a partly sectioned view of a further detail of the brake equipment of FIG. 1, the further detail being shown on an enlarged scale.

In FIG. 5 the brake pad is indicated at 16 in the brake release mode and at 16' in the brake applied mode.

Figure 3:
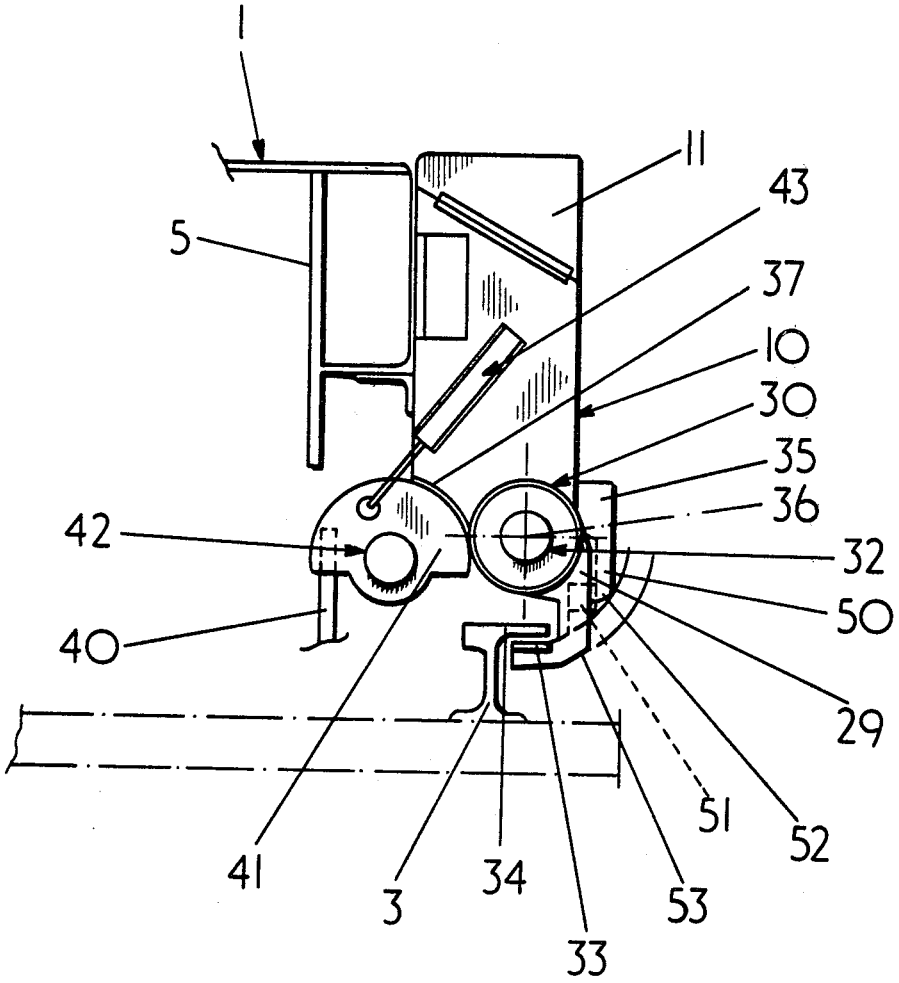
FIG. 3 is an incomplete end view of a detail of FIG. 1.
Figure 4:
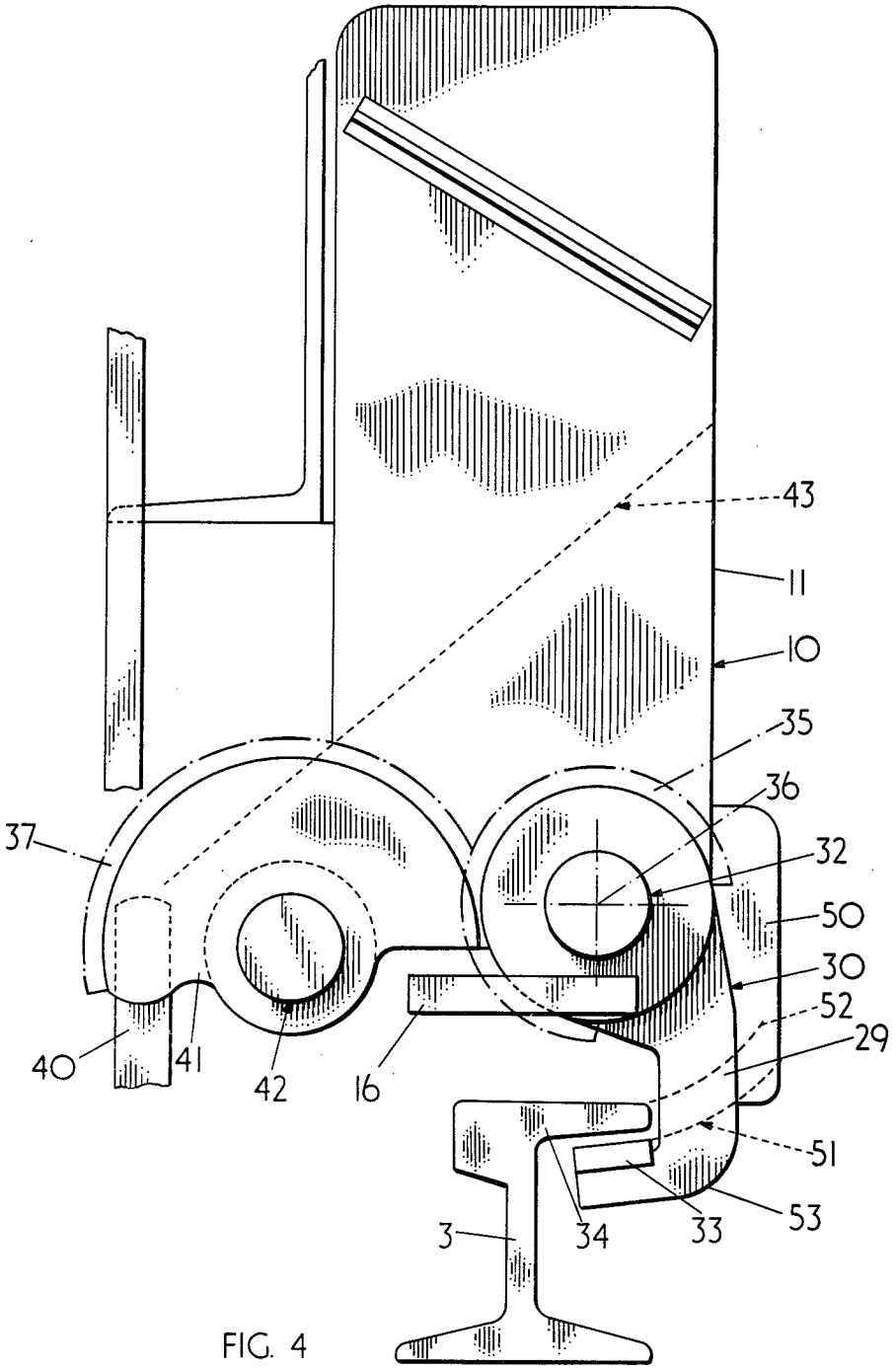
FIG. 4 is an incomplete end view of a part of the detail of FIG. 3 shown on an enlarged scale.

Referring now to FIGS. 1, 2, 3 and 4 of the drawings, each set of brake equipment 10 can be seen to comprise movable reaction means constituted by a generally 'U' shape reaction brake member or shoe 28 (as seen in FIG. 1) having limbs 30 and 31 pivotally mounted to opposite ends of the body component 11 by pivotal mounting means 32. The two limbs of the reaction brake shoe are connected by a cross piece component to which is bolted a removable reaction brake pad 33 which as seen in FIGS. 3 and 4 is locatable directly beneath one outwardly extending flange 34 of the stationary rail 3. The reaction brake shoe also comprises two gear tooth formations 35 arranged on an arcuate path around the pivotal axis 36 of the pivotal mounting means 32, the gear tooth formations 35 being fixed secured to the uppermost portions of the associated limbs 30, 31.

The arcuate gear formations 35 are drivably engaged by second arcuate gear formations 37, respectively, provided on abutment means comprising a vertical striker plate 40 which is arranged to abut stationary arrangements located along sections of the vehicle track or path as will be explained later in this specification and which is connected adjacent to its ends to two generally semi-circular components 41 pivotally secured to opposite ends of the body component 11 by pivotal mounting means 42. The generally semi-circular components 41 are provided with the previously mentioned gear tooth formations 37.

The abutment means further comprises a resiliently biassed compression spring arrangement 43 (only one of which is shown in FIG. 3) associated with the generally semi-circular component 41, respectively, and secured between the body component 11 and the associated pivotally mounted component 41. The action of the spring arrangements 43 is to resist clockwise movement of the pivotally mounted components 41 as seen in FIGS. 3 and 4 and thereby, to tend to retain the reaction brake pad 33 directly beneath the rail flange 34 thereby providing a reaction brake member when the brake is applied and the brake pad 16 is urged by the action of the stacks of springs 18 into abutment with the upper surface of the stationary rail 3 with braking effort.

When the brake is applied and the brake member 16 is slid downwards under the action of the springs 18 the reaction brake member 29 is retained with the reaction brake pad 33 directly beneath the flange 34 of the stationary rail by a slider 50 fixedly mounted on the movable brake member. In FIGS. 3 and 4 the slider is shown in its raised, i.e., brake released mode in which it lies directly against a recess 51 formed in the reaction brake member. With the slider in this raised position the reaction brake member is free to pivot about the pivotal mounting 32 in an anti-clockwise direction as seen in FIGS. 3 and 4 enabling the reaction brake pad 33 to move to the left as seen in FIGS. 3 and 4 clear of the stationary rail 3. However, when the brake is applied and the slider is slid downwards together with the brake member 15 the tongue 52 of the slider overlaps an abutment shoulder 53 provided on the reaction brake member 29 which thereby is retained with the reaction brake pad 33 directly beneath the outwardly direct flange 34 of the stationary rail and an efficient braking action is achieved.

In use, if reaction brake member 29 is in a raised position under the action of the abutment means as will be explained later in the specification, then the slider tongue 52 passes through the recess 51 and the reaction brake member is retained in a raised position. In such an occurrence the reaction brake member plays no part in the braking and the maximum applied braking effort will be dependent upon the weight of the vehicle acting through the brake pads 16 which are urged into contact with the upper surface of the stationary rail.

The vehicle brake equipment also comprises an overspeed unit 60 which is driven directly by a gear train 61 drivably connected to the axle 4 of a pair of wheels 2 and which thereby is arranged to sense the vehicle speed. The overspeed unit is provided in the hydraulic circuit for activating the hydraulic ram 20 and is arranged to exhaust the circuit if the vehicle speed is above a desired value thereby permitting the stack of springs 18 to urge the brake member 15 towards a brake applied mode. The hydraulic circuit is pressurised to release the brake by activation of a manually operated pump 64 provided on the vehicle chassis 5. Fluid for the hydraulic brake system is fed from a tank 65 also provided on the vehicle chassis.

Figure 8:
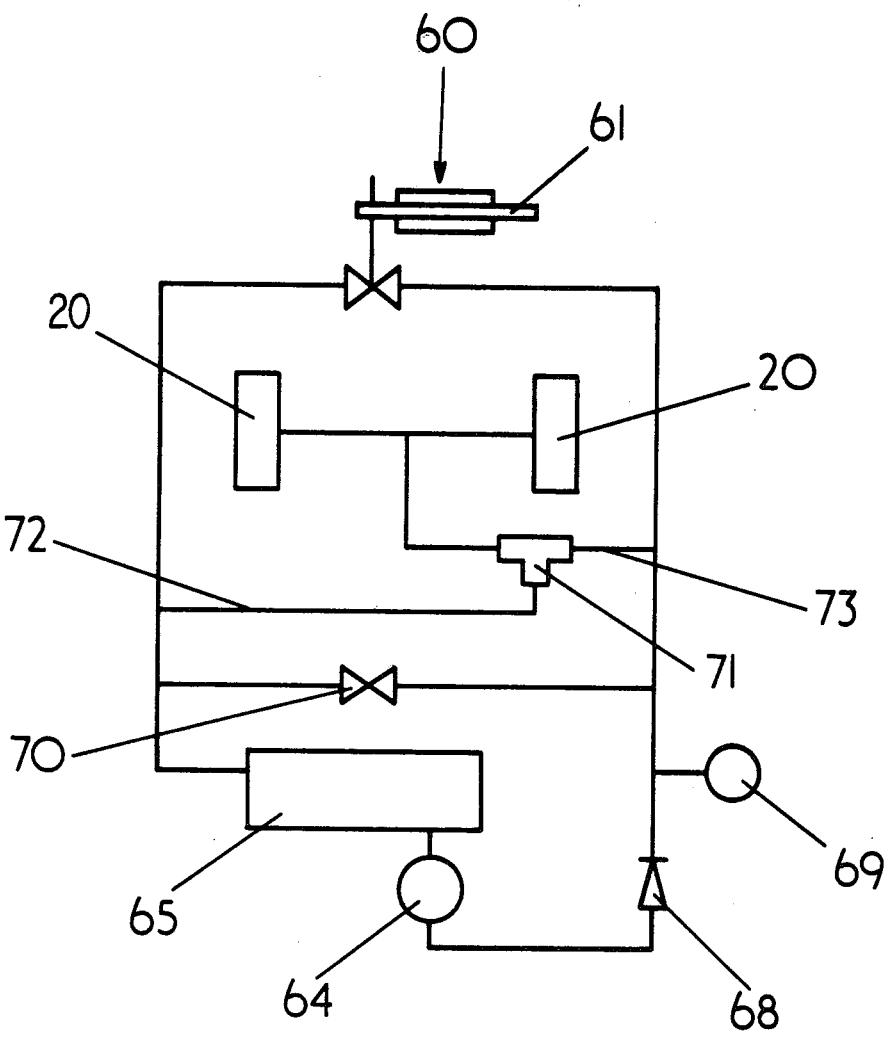
FIG. 8 is a hydraulic circuit diagram for the brake equipment of FIG. 1.

FIG. 8 shows the hydraulic circuit diagram for the brake circuit which includes the hydraulic rams 20, the overspeed unit 60, the pump 64 and the tank 65 previously discussed in this specification. In addition, the circuit includes a non-return valve 68, a pressure gauge 69, a manually operated release valve 70 for exhausting fluid pressure from the system to apply the vehicle brakes during parking, and a shuttle valve 71 provided to quickly dump brake fluid from the hydraulic rams 20 to tank when the brake is applied to facilitate rapid operation of the brakes. The exhaust from the shuttle valve along line 72 is closed when pressure fluid is fed along line 73 to actuate the hydraulic rams 20 to release the brakes. However, upon the shuttle valve sensing a fall in pressure in line 73 the exhaust part of the valve is open to dump brake fluid to exhaust. In the hydraulic circuit the two hydraulic rams 20 are associated with the two sets of brake equipment 10 located on opposite sides of the vehicle respectively.

In use, to release the brakes the pump 64 is manually operated by movement of lever 75 (see FIG. 2) to feed pressure fluid to retract the hydraulic rams 20 against the action of the stacks of disc springs 18, the shuttle valve exhaust being closed immediately pressure fluid is sensed in line 73. The pump is actuated until the brakes are fully released. The vehicle is then free to move with the train of vehicles. If the vehicle speed should attain an undesirably high value the overspeed unit is actuated to exhaust fluid to tank permitting the springs 18 to apply the brakes to reduce vehicle speed. With the embodiment shown in the drawings the brake can only be released by manual operation of the pump 64 as previously explained. In other embodiments, the pressure fluid feed is fed from a main supply provided on the locomotive. In such embodiments the brakes can be released by actuation of control means provided on the locomotive.

When the brake is applied either by actuation of the overspeed unit 60 or by activation of the valve 70 during parking of the vehicle, the brake member 15 together with the brake pad is urged towards the upper surface of the stationary rail 3 by the stacks of disc springs 18. Upon the brake pad abutting the upper surface of the stationary rail the vehicle chassis 5 tends to be lifted slightly until the reaction brake pad 33 is brought into contact with the lower side of the rail flange 34. The stationary rail 3 then tends to be gripped firmly between the brake members and the reaction brake members of each set of brake equipment.

Upon the vehicle travelling along the rail track it is necessary for the brake equipment to negotiate sections of the track, for example, point or crossover arrangements where obstacles exist in the operational path of the reaction brake member. At such sections of the track the previously mentioned stationary formations are provided which are abutted by the downwardly directed vertical striker plate 40 which thereby is urged upwards by contact with the stationary formation. Upward movement of the striker plate 40 urges the associated generally semi-circular components 41 to pivot about the pivotal mountings 42 in a clockwise direction as seen in FIGS. 3 and 4 causing the gear tooth arrangements 37 to drivably engage the gear tooth arrangement 35 and thereby pivot the reaction brake members 29 about the pivotal mountings 32 in an anti-clockwise direction as seen in FIGS. 3 and 4. Thus, the reaction brake members 29 including the reaction brake pads 33, are pivoted clear of the stationary rail permitting unobstructed travel of the vehicle over the section of track. When the section is passed the station formation is terminated allowing the striker plate 40 to return to its relatively lower position under the action of the spring arrangement 37 which thereby urges the reaction brake member 29 to return to its normal operational position with the reaction brake pad 33 located directly beneath the lower side of the flange 34 of the stationary rail.

As explained previously if the brake is applied whilst the striker plate 40 is abutting the stationary formation, the tongue 52 of the slider 50 passes through the recess 51 permitting the brakes to be applied without the action of the reaction brake member.

Figure 9:
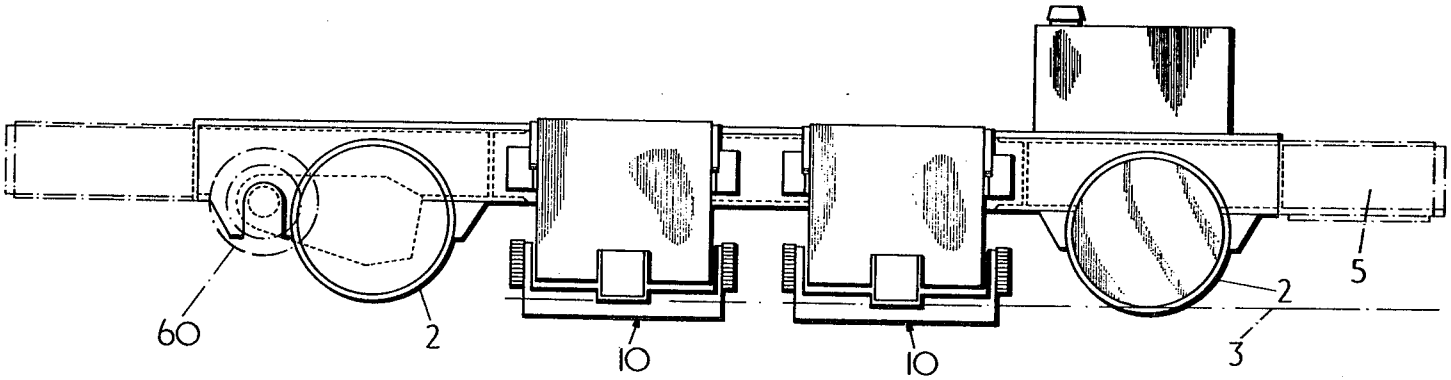
FIG. 9 is an incomplete side view of a rail mounted vehicle provided with additional sets of brake equipment constructed in accordance with the present invention.

FIG. 9 shows a vehicle provided with four sets of brake equipment 10, each set of brake equipment being constructed substantially as previously described with reference to FIGS. 1 to 8. Such an arrangement gives a great braking effort and is for fitting to heavy duty vehicles.

I claim:

1. Vehicle brake equipment for a vehicle adapted to travel along a stationary rail, comprising a body component adapted to be mounted on the vehicle, brake means having a brake applied mode in which a brake member is urged towards the stationary rail with braking effort, and a brake release mode in which the brake member is not urged towards the stationary rail with braking effort, means for applying the braking effort to the brake member when, in use, the brake is applied, movable reaction means having one operational mode in which a reaction brake member is located on the opposite side of the stationary rail to said brake member and having a second operational mode in which the reaction brake member is clear of the stationary rail, drive means for urging the reaction brake member towards said one operational mode, and abutment means which are arrangeable to abut a stationary formation located along a section of the vehicle path and which when abutting the formation are arranged to override the action of the drive means to urge the reaction brake member towards said second operational mode in which the reaction brake member is clear of the stationary rail.

2. Equipment as claimed in claim 1, in which the movable reaction means comprises a pivotal mounting for the reaction brake member.

3. Equipment as claimed in claim 2, in which the reaction brake member comprises a generally hook shaped brake shoe.

4. Equipment as claimed in claim 3, in which the brake shoe is provided with a brake pad.

5. Equipment as claimed in claim 4, in which the brake shoe comprises a gear tooth formation.

6. Equipment as claimed in claim 5, in which the gear tooth formation is arranged on an arcuate path around the pivotal axis of the pivotal mounting.

7. Equipment as claimed in claim 6, in which the abutment means comprises a striker plate for abutment with the stationary formation and a gear tooth formation drivably engaging the gear tooth formation on the brake shoe.

8. Equipment as claimed in claim 7, in which the gear tooth formation on the abutment means is arranged on an arcuate path around a second pivotal axis which is substantially parallel to the first mentioned pivotal axis, the abutment means comprising a pivotal mounting means.

9. Equipment as claimed in claim 8, in which the brake equipment comprises a slide mechanism adapted to retain the brake shoe in said one operation mode in which the reaction brake member is located on the opposite side of the stationary rail to said brake member.

10. Equipment as claimed in claim 9, in which the brake shoe is recessed to allow movement of the slide mechanism when the brake shoe is in said second operational mode clear of the stationary rail when the brake is applied.

11. Equipment as claimed in claim 1, in which the means for applying the braking effort comprises resiliently biassed means.

12. Equipment as claimed in claim 11, in which the brake equipment comprises hydraulic means for overriding the action of resilient biassed means in the brake released mode.

13. Equipment as claimed in claim 1, in which the brake equipment comprises vehicle speed sensitive means arranged to actuate the brake means to apply the vehicle brake.

* * * * *